US008834975B1

(12) United States Patent
Friedman

(10) Patent No.: US 8,834,975 B1
(45) Date of Patent: Sep. 16, 2014

(54) INDEPENDENT BLOCK BUILDING SYSTEM

(76) Inventor: Adam Friedman, Santa Monica, CA (US)

( * ) Notice: Subject to any disclaimer, the term of this patent is extended or adjusted under 35 U.S.C. 154(b) by 419 days.

(21) Appl. No.: 13/197,145

(22) Filed: Aug. 3, 2011

(51) Int. Cl.
*A63H 29/08* (2006.01)

(52) U.S. Cl.
USPC .... 428/33; 297/218.1; 297/218.2; 297/218.3; 297/218.5

(58) Field of Classification Search
USPC ..... 428/33; 297/218.1, 218.2, 218.3
See application file for complete search history.

(56) References Cited

U.S. PATENT DOCUMENTS

| | | | | |
|---|---|---|---|---|
| 1,995,264 | A * | 3/1935 | Mason | 52/591.1 |
| 2,892,489 | A | 6/1959 | Hurley | |
| 2,980,167 | A | 4/1961 | Harris et al. | |
| 3,154,345 | A | 10/1964 | Lambrecht | |
| 3,329,466 | A | 7/1967 | Getz et al. | |
| 3,586,091 | A * | 6/1971 | Roberts | 160/231.2 |
| 3,612,607 | A | 10/1971 | Lohr | |
| 4,713,854 | A | 12/1987 | Graebe | |
| 4,856,844 | A | 8/1989 | Isono | |
| 5,123,705 | A * | 6/1992 | Johnson | 297/423.4 |
| 6,089,657 | A | 7/2000 | Banno et al. | |
| 6,152,740 | A * | 11/2000 | Corrado | 434/172 |
| 7,740,321 | B2 | 6/2010 | Brill et al. | |
| 2009/0162579 | A1 * | 6/2009 | McDuff | 428/17 |

FOREIGN PATENT DOCUMENTS

| | | |
|---|---|---|
| GB | 2.192.33 | 1/1998 |
| WO | WO94/12080 | 6/1994 |

* cited by examiner

*Primary Examiner* — Brent O'Hern
(74) *Attorney, Agent, or Firm* — Michael I. Kroll

(57) ABSTRACT

A modular block system that is aesthetically and functionally versatile by providing a plurality of independent puzzle-like block members to form furniture, table, wall and floor coverings.

11 Claims, 19 Drawing Sheets

INDEPENDENT BLOCK BUILDING SYSTEM

BACKGROUND OF THE INVENTION

1. Field of the Invention

The present invention relates generally to building systems and, more specifically, to an independent block building system for configuring furniture, walls, flooring, table tops and the like. The present invention comprises a plurality of independent puzzle-like block members that work in conjunction with one another to form a surface for aesthetic and functional purposes. The block members can be any of a multitude of shapes, sizes, thicknesses, colors and other such variables. Block members are manufactured of a material including, but not limited to, wood, leather, stone, glass, resin, steel and resilient substances like rubber and dense foam or a composite of any number/variety of materials. Block members are placed adjacently to form or cover the desired object. A cushioning material or cushioning system, etc. may be employed as a base for the block members with any of a plurality of attachment and/or securing methods including hook and loop fasteners, strings, bungees, interlocking blocks, framework and frictional engagement.

2. Description of the Prior Art

There are other building methods for providing furniture pieces, flooring and wall coverings. While these building methods may be suitable for the purposes for which they were designed, they would not be as suitable for the purposes of the present invention as heretofore described.

SUMMARY OF THE PRESENT INVENTION

A primary object of the present invention is to provide a modular block building system for building furniture, tabletops and the like with a plurality of independent puzzle-like block members positioned adjacent to one another.

Another object of the present invention is to provide a modular block building system for providing floor and wall coverings utilizing a plurality of said block members.

Still another object of the present invention is to provide a modular block building system wherein said blocks are available in a plurality of shapes, sizes, materials, colors and other such variables.

Yet another object of the present invention is to provide a modular block building system wherein said block members are manufactured of a material including, but not limited to, wood, stone, glass, resin, steel, leather, metal, rubber, dense foam or any other suitable material.

Another object of the present invention is to provide a modular block building system wherein said block members may be placed on a resilient cushioning base or system such as foam or springs or magnets when used for furniture.

Yet another object of the present invention is to provide a modular block building system wherein said cushioning base may include a mesh or fabric covering on which said block members are seated.

Still yet another object of the present invention is to provide a modular block building system wherein said cushioning base is supported by traditional style strapping.

Another object of the present invention is to provide a modular block building system wherein said strapping, base and block members are retained in position by a solid framework.

Still another object of the present invention is to provide a modular block building system wherein block members disposed on said base are displaceable when said base is compressed due to a bias applied to said block members.

Yet another object of the present invention is to provide a modular block building system wherein the layout of said block members can be free floating or interlocking.

Still yet another object of the present invention is to provide a modular block building system wherein said block members are tied together utilizing elements such as hook and loop fasteners, string and/or bungee passing therethrough.

Another object of the present invention s provide a modular block building system wherein said base employs bungees or an internal mechanism within said block members that interlock and provide a cushioning effect.

Additional objects of the present invention will appear as the description proceeds.

The present invention overcomes the shortcomings of the prior art by providing a modular block system that is aesthetically and functionally versatile by providing a plurality of independent puzzle-like block members to form furniture, table, wall and floor coverings.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
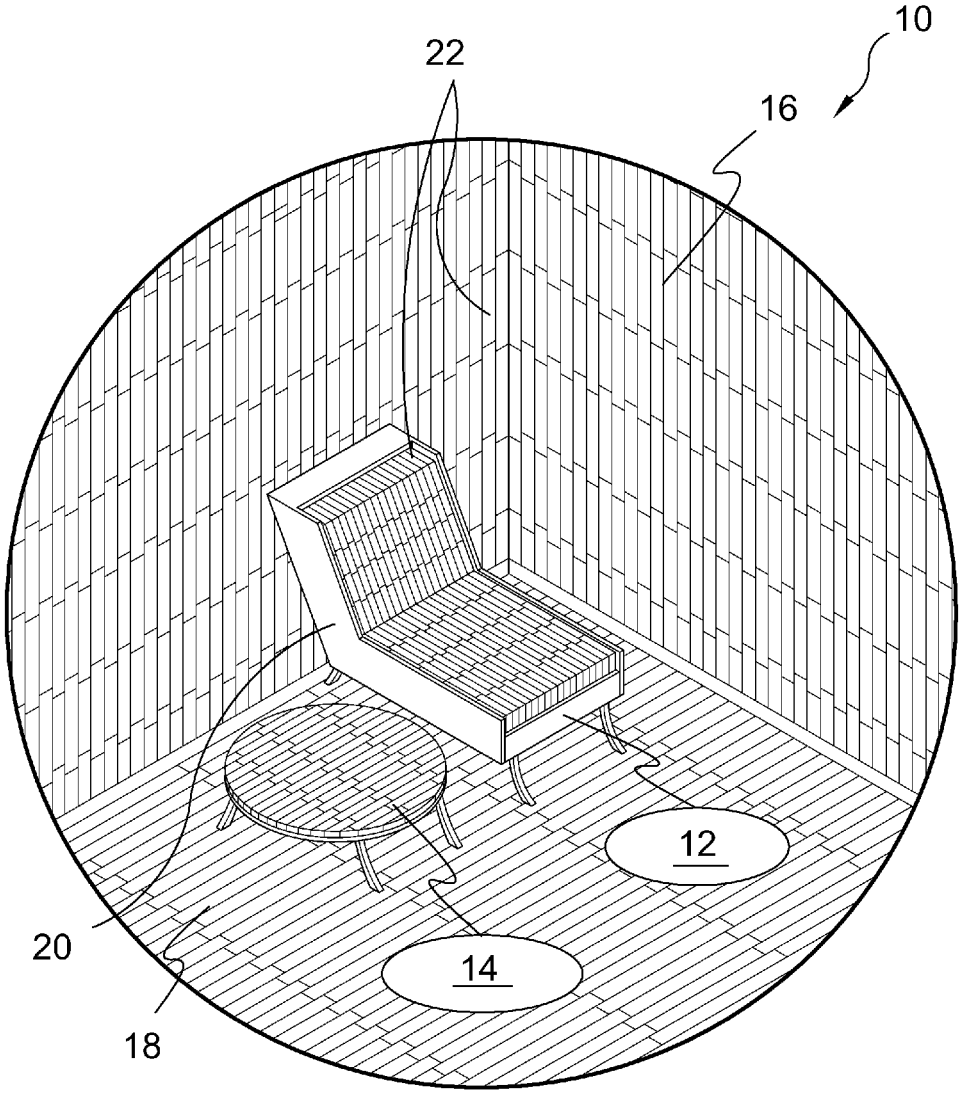
FIG. 1 is an illustrative view of the block construction design of the present invention in use.

Turning now descriptively to the drawings, in which similar reference characters denote similar elements throughout the several views, the figures illustrate the Independent Modular Block Building System of the present invention. With regard to the reference numerals used, the following numbering is used throughout the various drawing figures.

10 Independent Modular Block Building System of the present invention
12 furniture
14 table top
16 wall
18 floor
20 frame
22 independent modular block member
24 chair
26 foam
28 strapping
30 fabric cover
32 user
34 block displacement
36 cushion surface substrate
38 right angle block
40 U-shaped block
42 cross shaped block
44 tubular block
46 inverted Z-block
48 straight shaped block
50 free floating application
55 connective member
56 polymeric connective member
58 elastomeric connective member
60 fibrous connective member
62 Velcro
64 lounge chair
66 table
68 magnet
70 magnetic block substrate
72 external face of 68
74 magnetic repulsion
76 solid surface substrate
78 magnetic attraction
80 positively polarized magnetic face
82 negatively polarized magnetic face
84 low frictional coating
86 side of 22
88 interblock magnet
90 composite
92 direct adhesion
94 hard component of 90
96 soft component of 90

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the independent modular block building system 10 of the present invention in use. The present invention is a modular block building system 10 for covering furniture 12, table tops 14, walls 16 and floors 18 comprising frame 20 constrained independent block members 22 forming a functional, decorative covering for said furniture 12, table tops 14, walls 16 and floors 18 that optionally provides for a line, such as cord, polymeric line or elastomeric line extending longitudinally or transversely through a plurality of said blocks.

Figure 2:
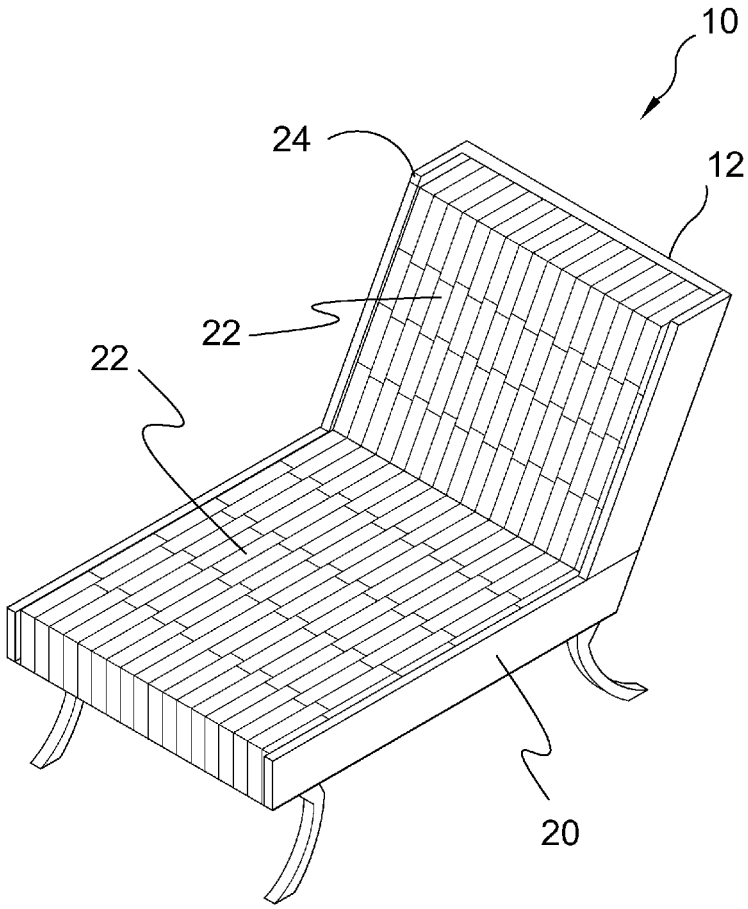
FIG. 2 is a perspective view of the block construction design of the present invention.

Referring now to FIG. 2, shown is a perspective view of the independent modular block building system 10 of the present invention. Illustrated is an embodiment of the block construction design for furniture 12 comprising frame 20 constrained independent block members 22 forming a support surface for a chair that may have an elastomeric or polymeric cushion thereunder.

Figure 3:
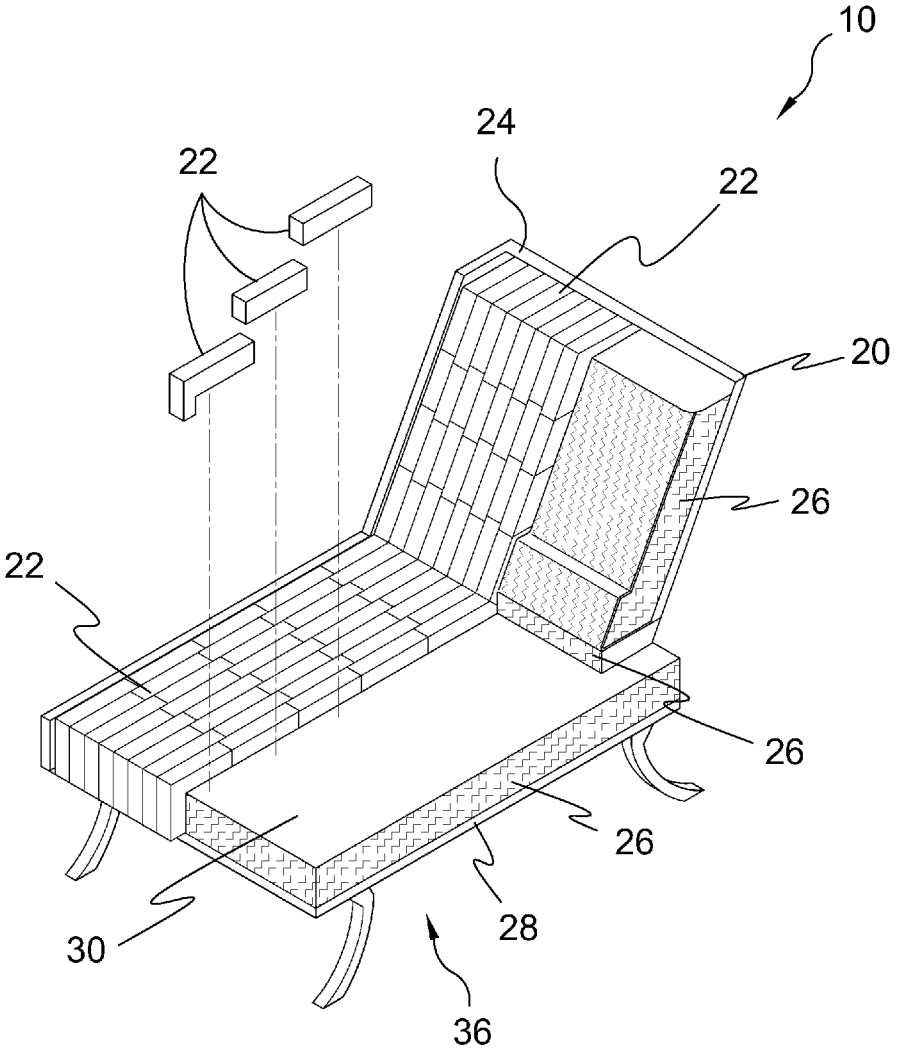
FIG. 3 is an exploded view of the present invention.

Referring now to FIG. 3 shown an exploded view of the independent modular block building system 10. Shown is an exploded view of the block construction design for a chair 24 having independent blocks 22 that may be free standing or connected by various means such as Velcro, string or bungee cord. Depicted are the block members 22 positioned on a foam 26 base 36 within a frame 20. The base 36 has a fabric covering 30 and rests on traditional strapping 28 communicating with the frame 20. Said blocks 22 can be of a variety of shapes and forms and materials. The block system 10 blankets all furniture forms, flooring, walls and table tops.

Figure 4:
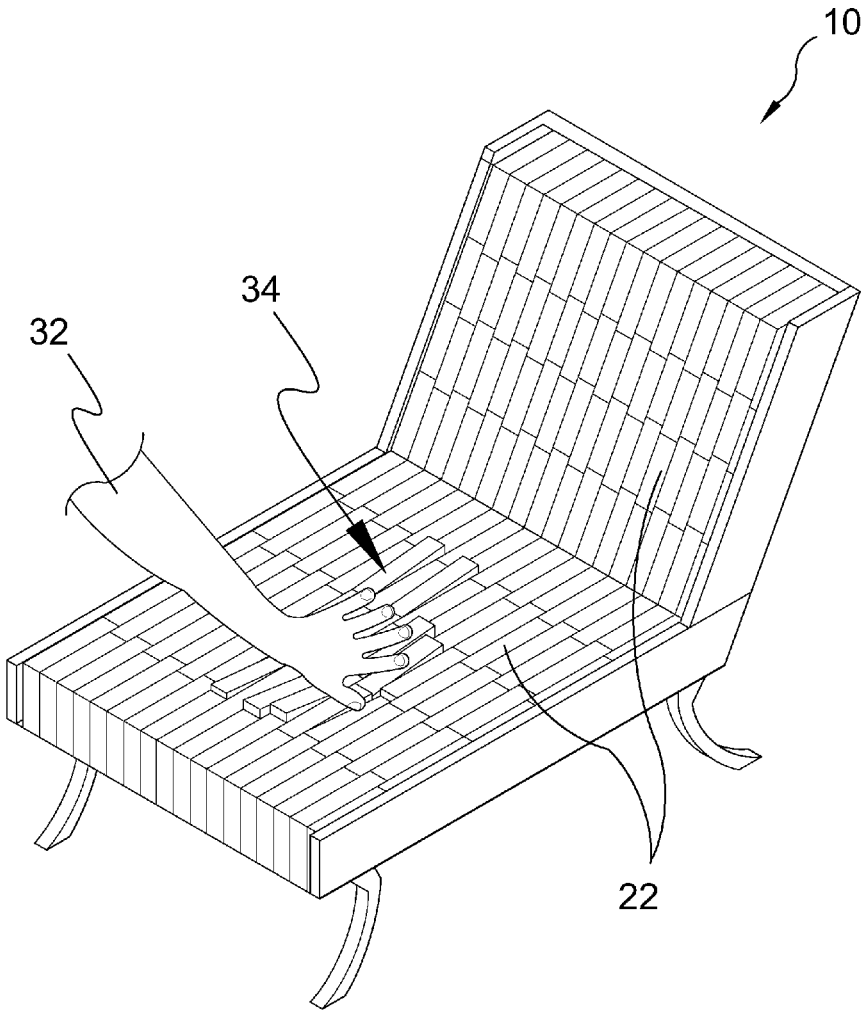
FIG. 4 is an illustrative view of the present invention.

Referring now to FIG. 4, shown is an illustrative view of the independent modular block building system 10. Shown is the user 32 applying a downward bias causing displacement 34 of the independent blocks 22 that may be free standing or connected by various means such as Velcro, string or bungee cord. The displacement 34 provides comfort when in use by conforming to the bias applied by the user 32 sitting thereon.

Figure 5:
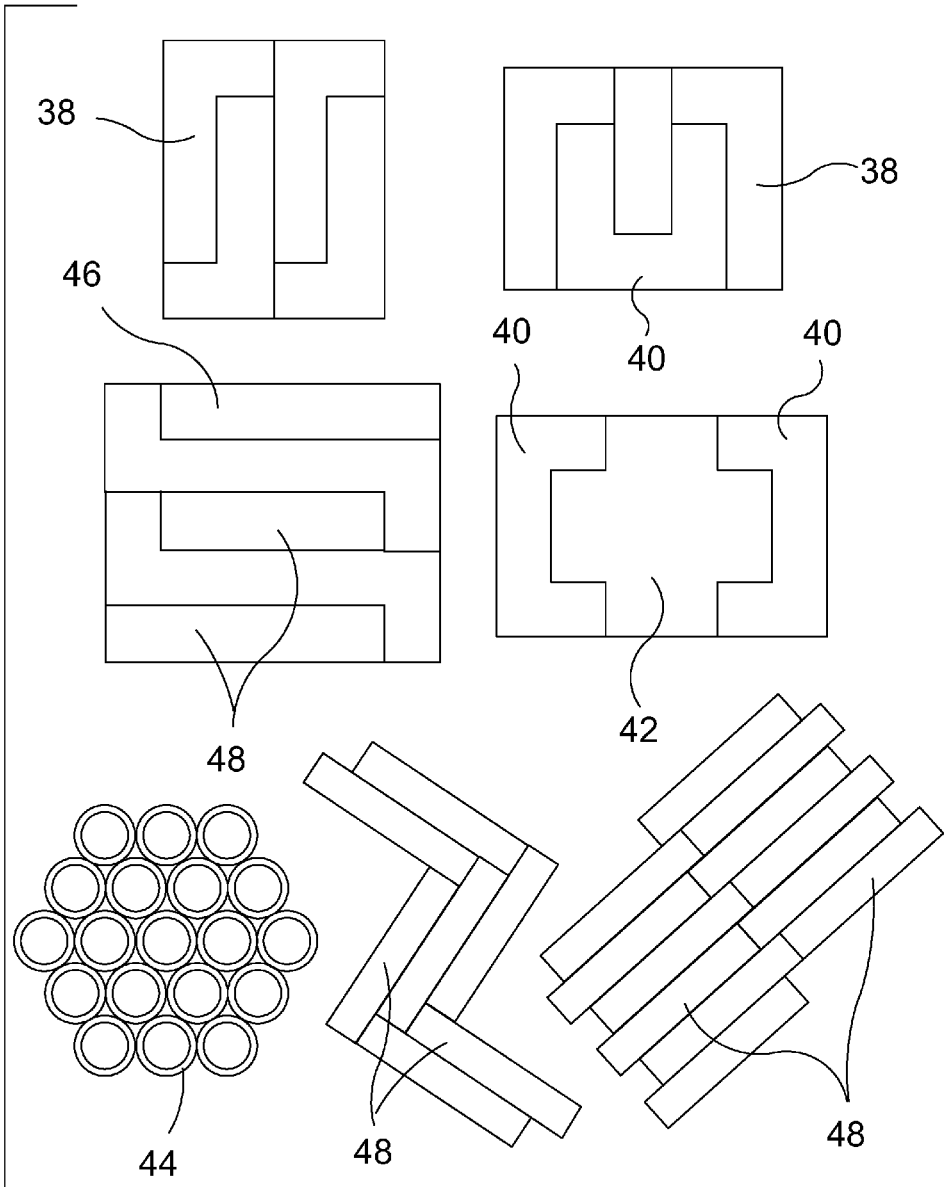
FIG. 5 are orthographic views of block construction designs of the present invention.

Referring now to FIG. 5, shown are orthographic views of block construction designs of the present invention. Shown are various forms of the independent block members of the present invention. Said blocks can be of a variety of shapes, forms and materials. Depicted are block members assuming right angle 38, U-shaped 40, cross shaped 42, tubular 44, inverted Z 46 and straight 48 configurations to provide an assortment of patterns.

Figure 6:
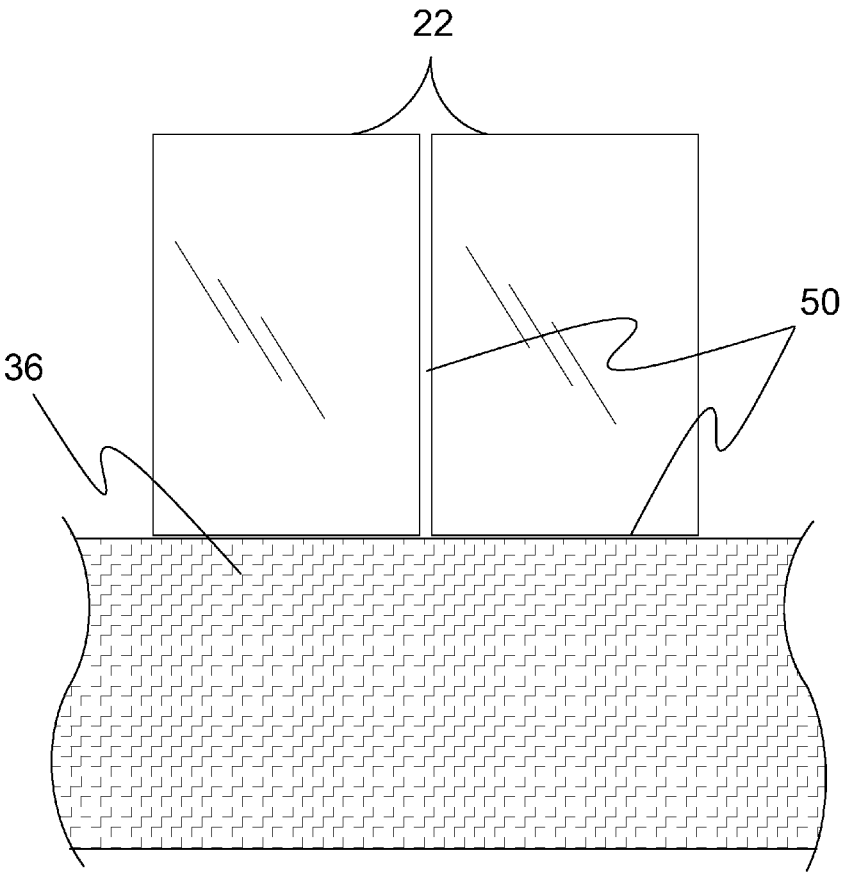
FIG. 6 is an illustrative view of the block members and resilient sub-surface.

Referring now to FIG. 6, shown is an illustrative view of the block members and resilient cushioned base surface 36. Shown is the block construction design that forms a planar support structure of any desired area by placing a plurality of said blocks 22 with abutting and or overlapping surfaces in a free floating application 50. Also shown are the block member support structure superjacently positioned on a resilient sub-surface, such as, foam and/or springs.

Figure 7:
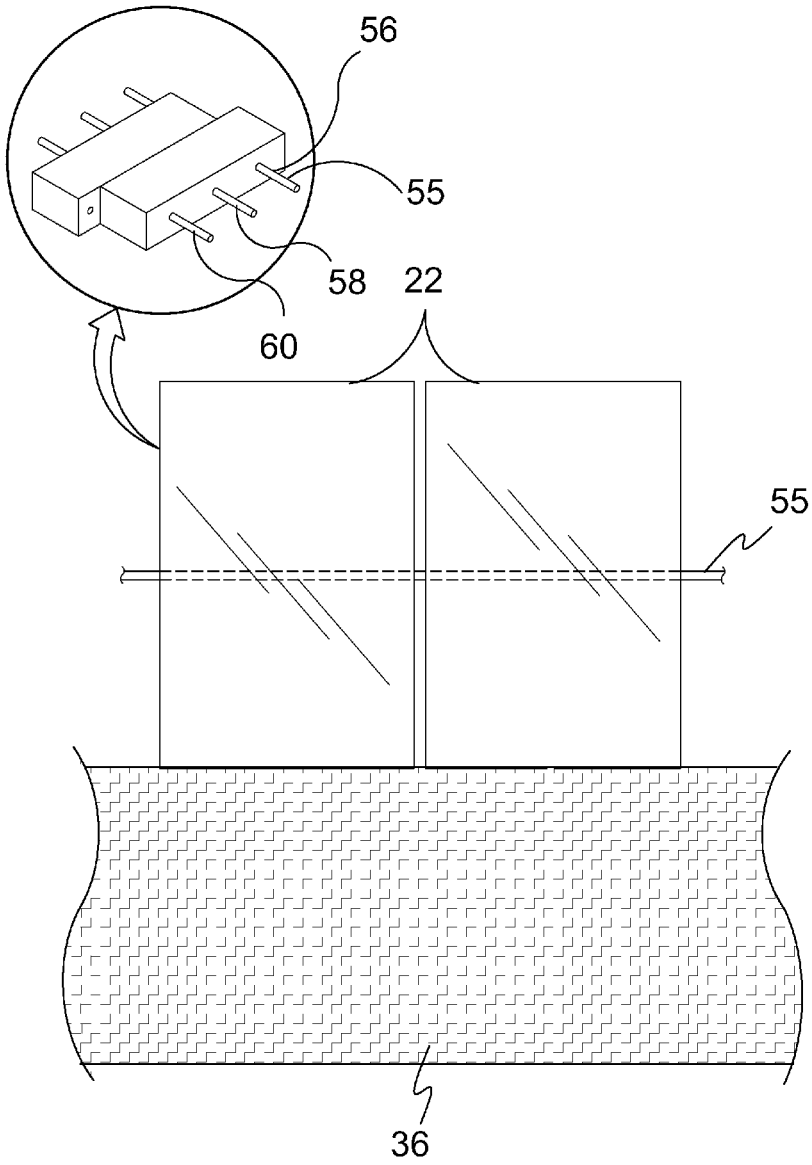
FIG. 7 is an illustrative view of the block members incorporating a connective member therebetween.

Referring now to FIG. 7, shown is an illustrative view of the block members 22 incorporating a connective member 55 therebetween. Shown is an embodiment of the block members 22 forming a support structure having one or more connective members 55 passing therethrough whereby any desired area of said block members 22 can be created using said connective members 55 therebetween selected from the group of polymeric 56, elastomeric 58 and fiber 60. Also shown is the block member cushioned base support structure 36 superjacently positioned on a resilient sub-surface, such as, foam and/or springs.

Figure 8:
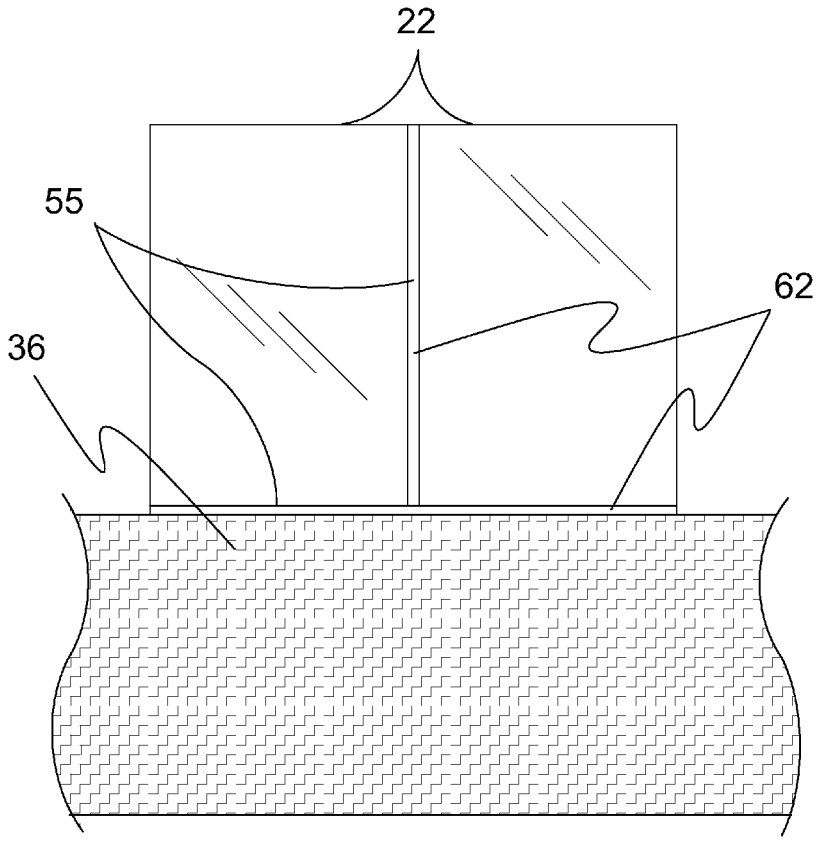
FIG. 8 is an illustrative view of the block members having a connective member therebetween.

Referring now to FIG. 8, shown is an illustrative view of the block members 22 having a connective member 55 therebetween. Shown is an embodiment of the block members 22 forming a support structure having a connective member 55 with mating Velcro 62 members fixed to facing block surfaces whereby any desired area of said block members can be created using said connective members, such as Velcro® 62. Also shown is the cushioned base 36 support structure superjacently positioned on a resilient sub-surface, such as, foam and/or springs.

Figure 9:
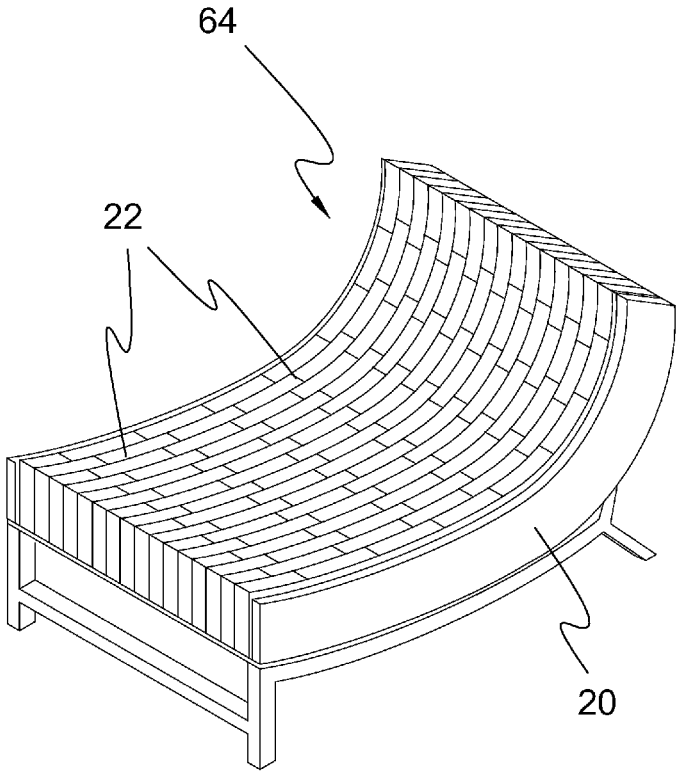
FIG. 9 is a perspective view of an additional element of the present invention.

Referring now to FIG. 9, shown is a perspective view of an additional element of the independent modular block building system 10. Shown is a block construction design for a lounge chair 64 having independent blocks 22 fitted together, forming a design and encompassed by a frame structure 20.

Figure 10:
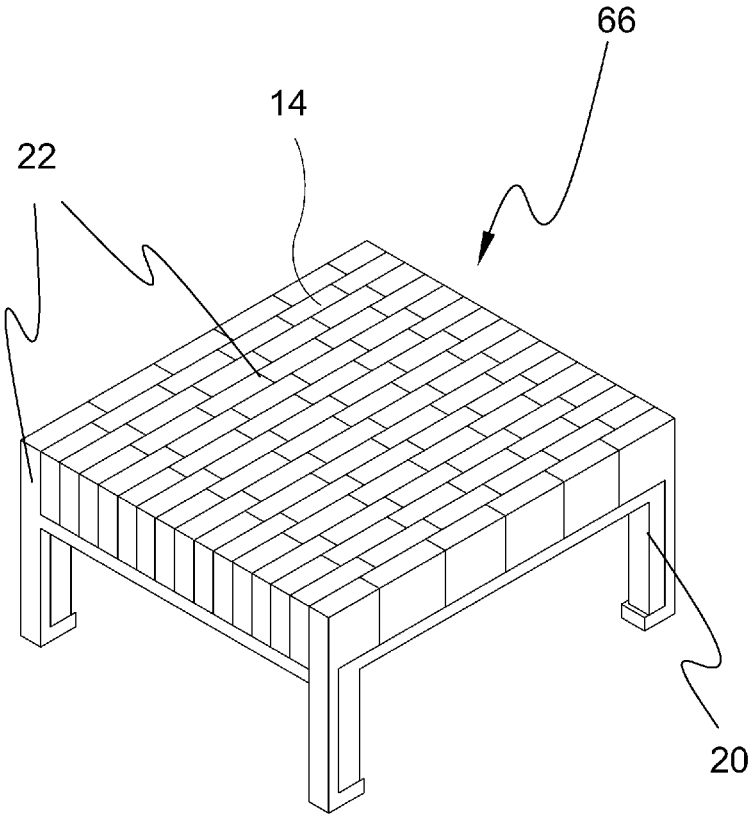
FIG. 10 is a perspective view of an additional element the present invention.

Referring now to FIG. 10, shown is a perspective view of an additional element the present invention. Shown is a block construction design for a table top 14 for a table 66 having independent blocks 22 fitted together, forming a design and encompassed by a frame structure 20.

Figure 11:
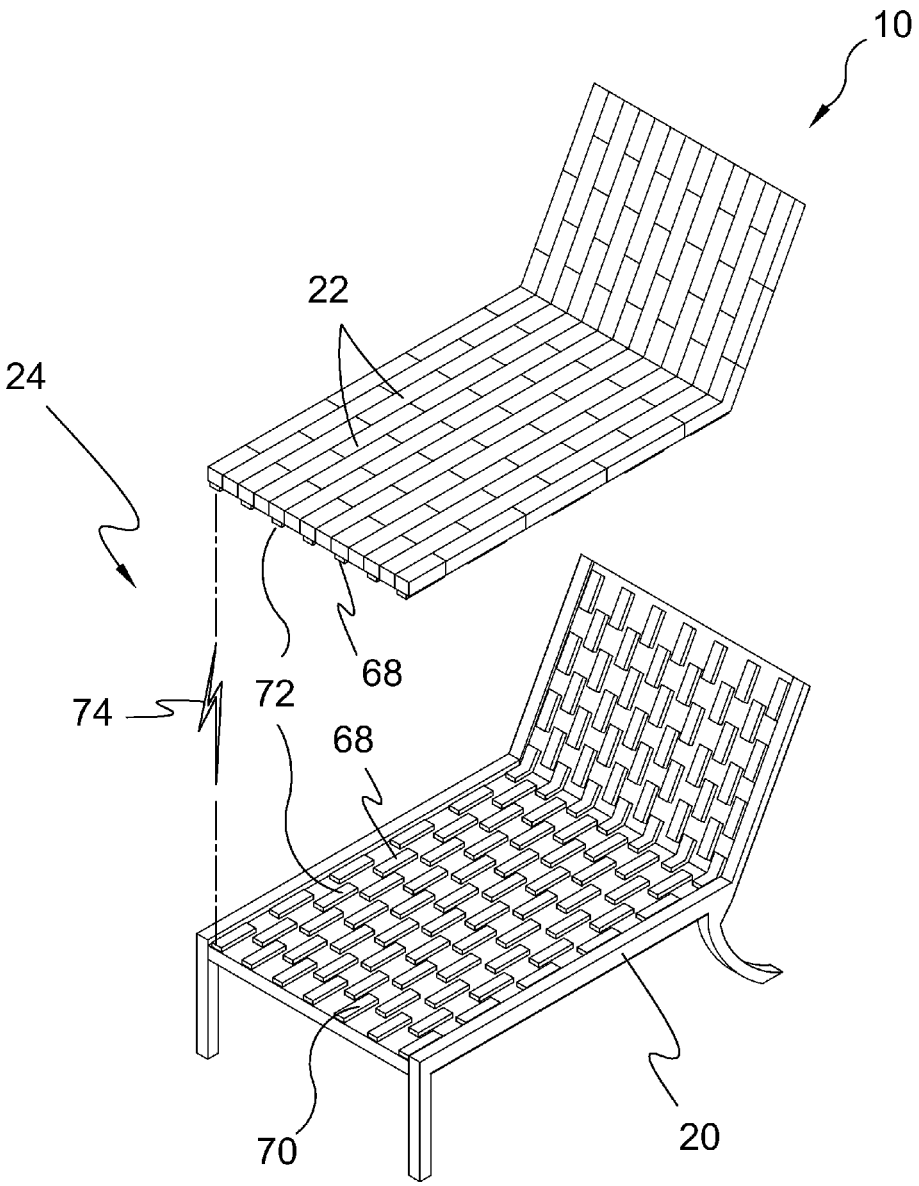
FIG. 11 is an exploded view of an additional element of the block construction design of the present invention.

Referring now to FIG. 11, shown is an exploded view of an additional element of the block construction design of the independent modular block building system 10. Illustrated is an embodiment of the block construction design for furniture comprising frame constrained independent blocks 22 forming a support surface for a chair 24 having magnets 68 fixed to the bottom of the blocks and magnets forming block substrate 70 on the frame 20 and superjacently positioned with external faces 72 having like poles facing each other so that the blocks22 will create a magnetic repulsion 74 that will repel the blocks 22 away from the magnet substrate 70.

Figure 12:
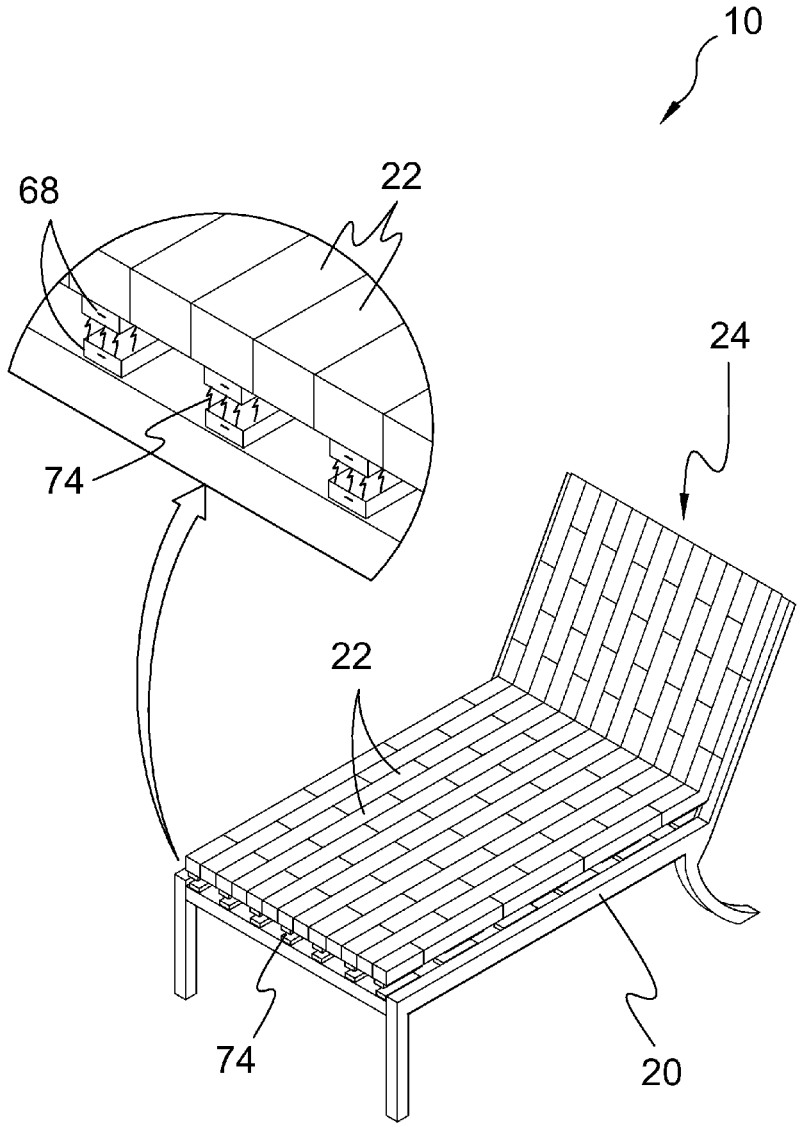
FIG. 12 is an enlarged view of the magnetic repelling block construction design of the present invention.

Referring now to FIG. 12, shown is an enlarged view of the magnetic repelling block construction design of the present invention. The independent modular block building system 10 provides embodiments of the independent block construction having a block substrate taken from the group of elastomeric cushion, polymeric cushion and magnets. Illustrated is an embodiment of the block construction design for furniture comprising frame constrained independent blocks 22 forming a support surface for a chair 24 having magnets 68 fixed to the bottom of the blocks and magnets forming block substrate 70 on the frame 20 and superjacently positioned with external faces having like poles facing each other so that the blocks 22 will create a magnetic repulsion 74 that will repel the blocks 22 away from the magnet substrate thereby suspending the blocks by the repelling of like magnetic poles.

Figure 13:
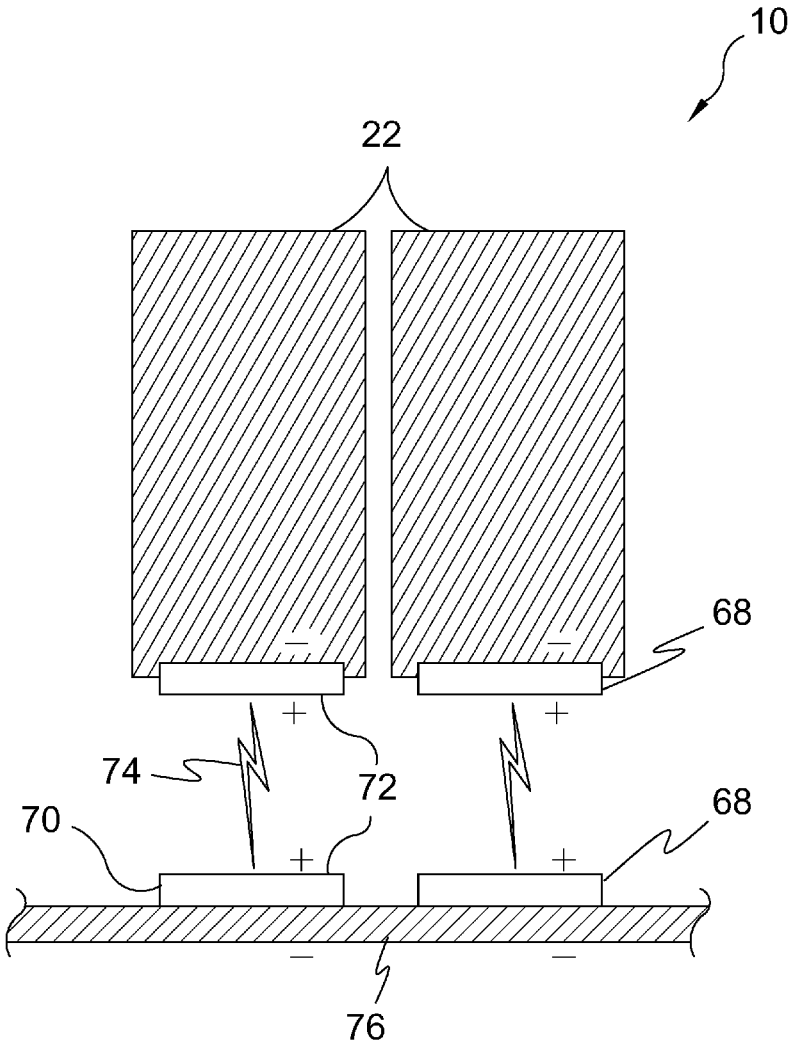
FIG. 13 is a detailed sectional view of the block construction incorporating magnets.

Referring now to FIG. 13, shown is a detailed sectional view of the independent modular block building system 10 incorporating magnets 68. Illustrated is the independent block construction design for furniture wherein each of the blocks 22 has a magnet 68 fixed to the bottom portion thereof and a plurality of subjacently placed magnets 68 fixed to a solid surface 76 forming substrate surface 70 for the block magnets 68. The magnets 68 are positioned with the external faces 72 having like poles facing each other thereby creating a magnetic repulsion 74 so each of the blocks 22 will be repelled by the substrate magnets.

Figure 14:
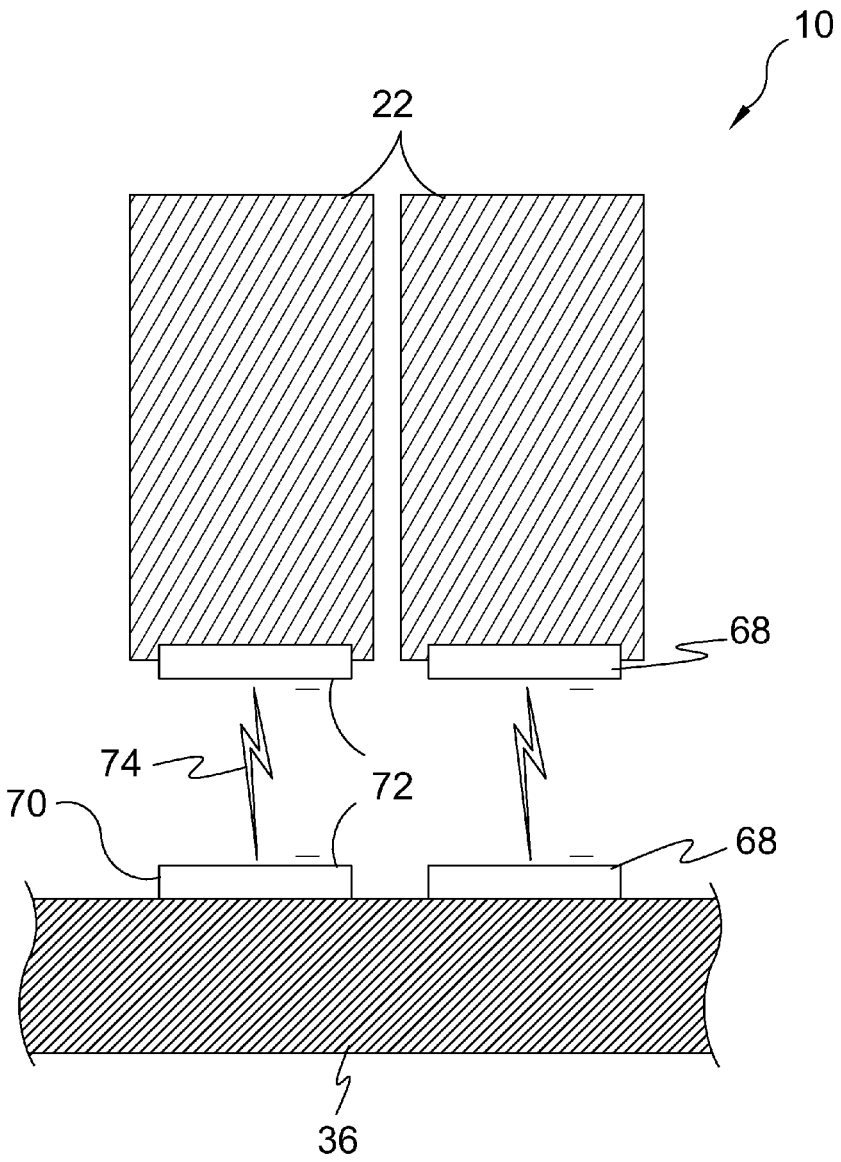
FIG. 14 is a detailed sectional view of the block construction design of the present invention.

Referring now to FIG. 14, shown is a detailed sectional view of the independent modular block building system 10 incorporating magnets 68. Illustrated is the independent block construction design for furniture wherein each of the blocks 22 has a magnet 68 fixed to the bottom portion thereof and a plurality of subjacently placed magnets 68 fixed to the cushioned base 36 forming substrate surface 70 for the block magnets 22. The magnets 68 are positioned with the external faces 72 having like poles facing each other thereby creating a magnetic repulsion 74 so each of the blocks 22 will be repelled by the substrate magnets.

Figure 15:
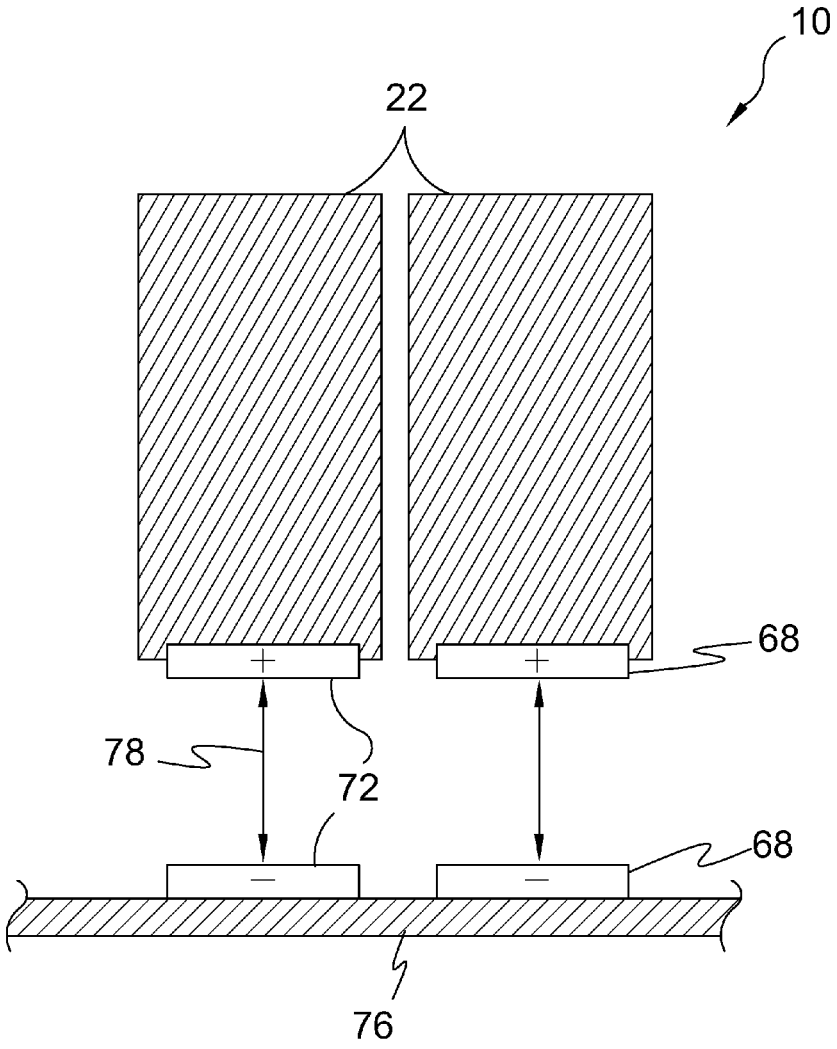
FIG. 15 is a detailed sectional view of the block construction incorporating magnets.

Referring now to FIG. 15, shown is a detailed sectional view of the independent modular block building system 10 incorporating magnets 68. Illustrated is the independent block construction design for furniture wherein each of the blocks 22 has a magnet 68 fixed to the bottom portion thereof and a plurality of subjacently placed magnets 68 fixed to a solid surface 76 forming substrate surface 70 for the block magnets 68. The magnets 68 are positioned with the external faces 72 having opposing poles facing each other thereby creating a magnetic attraction 78 so each of the blocks 22 will be attracted by the substrate magnets.

Figure 16:
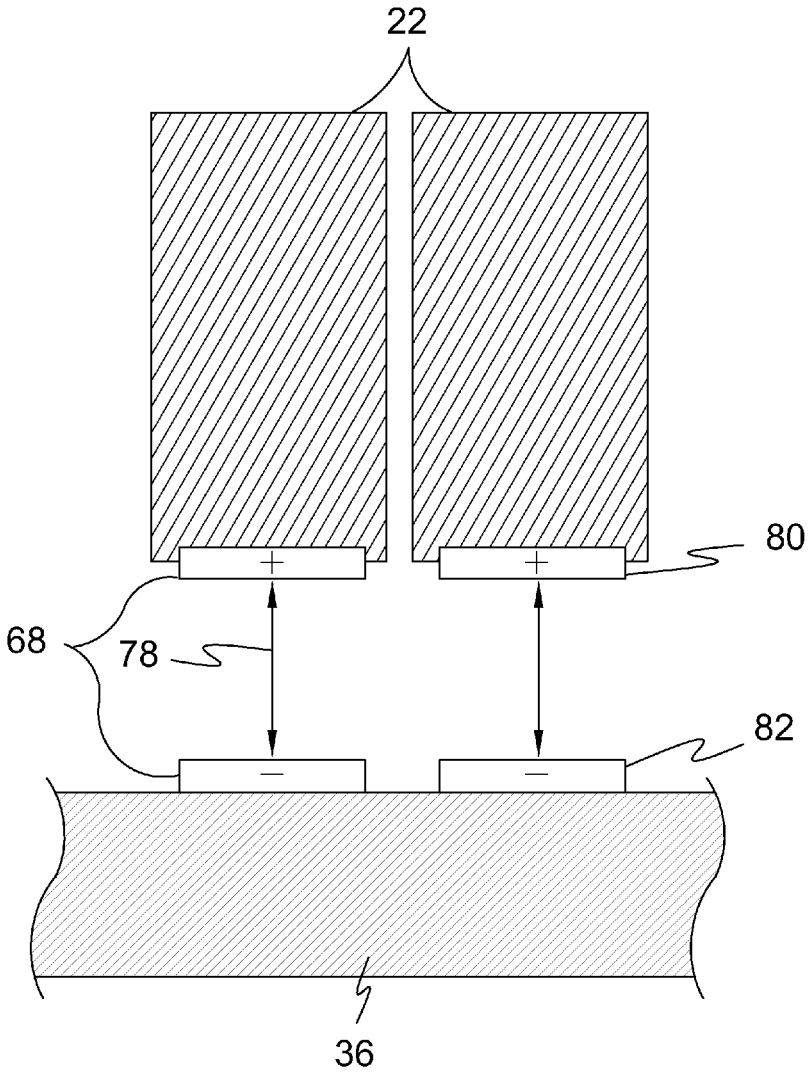
FIG. 16 is a detailed sectional view of the block construction incorporating magnets.

Referring now to FIG. 16, shown are the magnets 68 having an external negatively polarized magnet face 82 and the corresponding magnet having an external positively magnetic face 80 thereby creating a magnetic attraction 78 of the block members 22 to a cushion surface base substrate 36.

Figure 17:
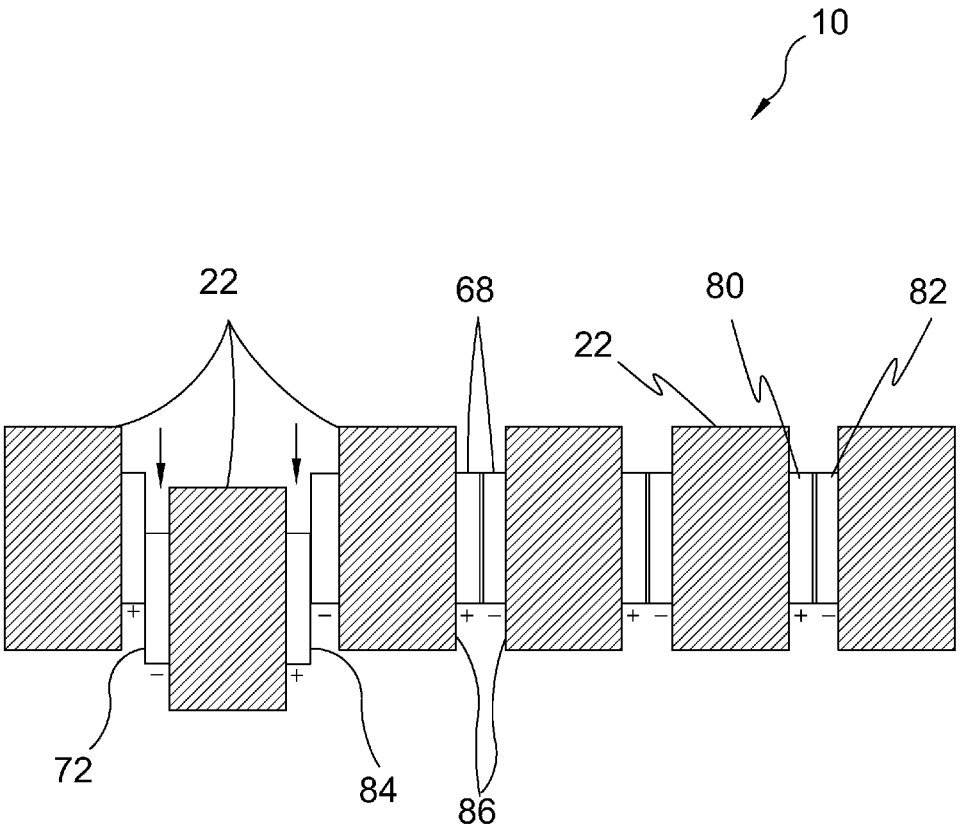
FIG. 17 is a detailed sectional view of the block construction incorporating magnets.

Referring now to FIG. 17, shown is a detailed sectional view of the independent modular block building system 10 incorporating magnets 68. Illustrated is the independent block construction design for furniture wherein each of the plurality of blocks 22 has a positively polarized magnetic face 80 on one side 86 and a negatively polarized magnetic face 82 fixed to its opposite side 86 with the poles reversed relative to the adjacent blocks 22 so that one side as an external north pole while the other has an external south pole. Block assembly of unlike poles forms block attraction from one to the other. Also provided is coating 84 the engaging external magnetic faces 72 with a low frictional coefficient material, which will ensure the blocks 22 slidably returning to a substantially planar at rest position.

Figure 18:
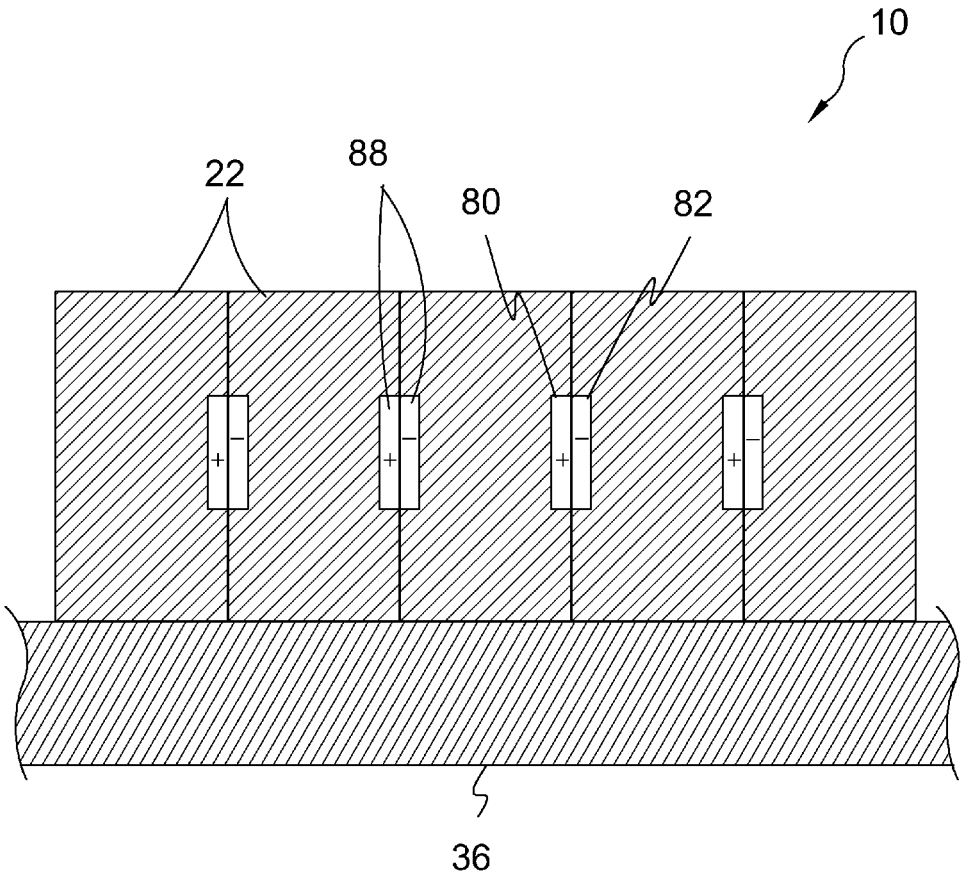
FIG. 18 is an illustrative sectional view of the block construction incorporating interblock magnets.

Referring now to FIG. 18, shown is an illustrative sectional view of the independent modular block building system 10 incorporating interblock magnets 88. Illustrated is the independent block construction design for furniture wherein each of the plurality of blocks 22 has a recessed interblock magnet 88 fixed to its opposite side with the poles reversed so that one side as an external positively polarized magnetic face 80 while the other has an external negatively polarized magnetic face 82. Block assembly of unlike poles forms block attraction from one to the other. Also provided is coating the engaging surfaces with a material having a low friction coefficient that will ensure the blocks 22 slidably returning to a substantially planar at rest position. Also shown is the plurality of magnetically joined blocks having a cushioned base 36 substrate comprising an elastomeric or polymeric substrate.

Figure 19:
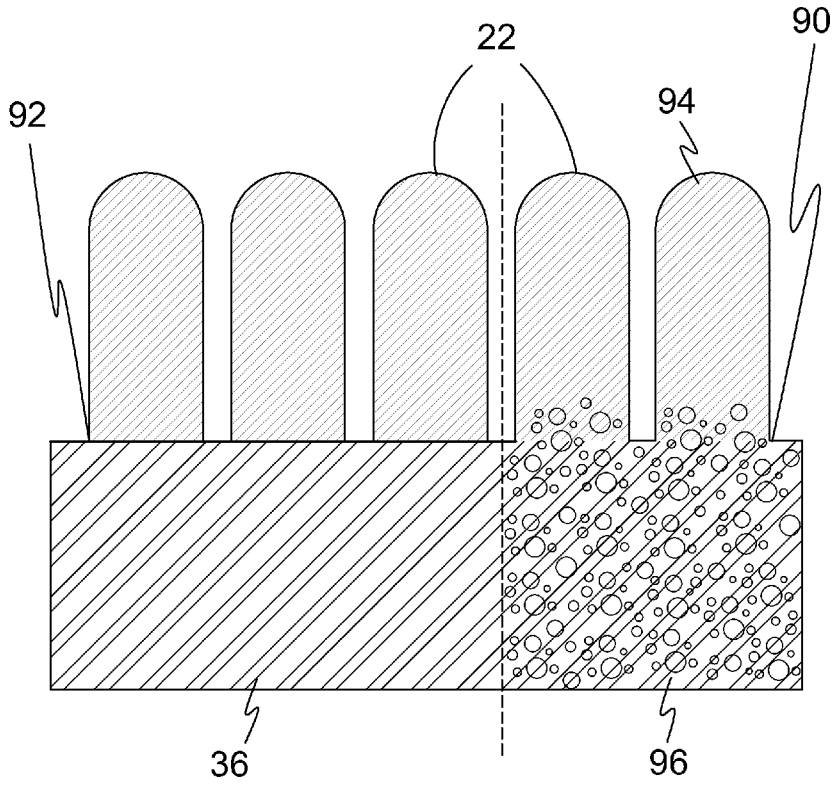
FIG. 19 is an illustrative view of the block members compositely conjoined to a cushioned base.

Referring now to FIG. 19, shown are the block members 22 compositely conjoined 92 to a cushioned base 36 and integral with a composite 90 blending hard 94 and soft 96 components.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A modular block building system to provide a covering for articles of furniture, tabletops, flooring and walls comprising:

a) surface areas on said articles;

b) a plurality of independent puzzle-like block members manufactured of a solid material selected from the group consisting of wood, stone, glass, resin, metal and steel positioned adjacent to one another on said surface areas to form new outer surfaces for aesthetic and functional purposes;

c) a framework for holding the block members in a predetermined position; and d) said surface areas each having a cushioning base wherein individual block members on said cushioning base are displaceable when a bias is applied thereto thus compressing said cushioning base for providing comfort to a user and to return said block members to their original positions once said biased is removed therefrom.

2. The modular block building system according to claim 1, wherein said block members have a plurality of shapes, sizes and colors to provide the capability of installing said blocks in a plurality of patterns.

3. The modular block building system according to claim 1, wherein said cushioning base is selected from the group consisting of foam, mesh, fabric covering and strapping.

4. The modular block building system according to claim 1, wherein said block members are interlocking.

5. The modular block building system according to claim 4, wherein said interlocking includes cushioning.

6. The modular block building system according to claim 1, wherein said framework includes mating hook and loop strips on sides of each said block member to engage said blocks to their adjacent blocks.

7. An independent block building system to provide a decorative, functional covering for furniture, table tops, walls and flooring comprising:

a) a plurality of independent blocks in a plurality of sizes, colors and shapes assuming right angle, U-shaped, cross shaped, tubular, inverted Z-shaped and straight configurations manufactured of a material selected from a group consisting of wood, stone, glass, resin, steel, and with said blocks installed on a surface and covering said surface in interlocking fashions in a plurality of decorative patterns according to selected shapes, sizes and colors of said blocks;

b) a framework associated with said surface for retaining said independent blocks therein;

c) a plurality of connective members selected from the group consisting of cord, fiber, string, bungee cord, polymeric line and elastic line extending through or attached to a plurality of said blocks for maintaining alignment of said independent blocks with one another;

d) fastening members for maintaining positioning of said independent block members on said surface selected from the group consisting of hook and loop mating strips and attracting magnetic elements for engaging said independent blocks to said surface; and e) a cushioned substrate on said surface comprising a foam cushion, fabric covering and strapping that allows for the displacement of said independent blocks when a bias is applied thereto thereby compressing said cushion and returning said blocks to a substantially planar resting state.

8. A chair having a modular block cover comprising:

a) a surface area on said chair;

b) a plurality of independent puzzle-like solid block members positioned adjacent to one another on said surface area to form an outer surface for aesthetic and functional purposes;

c) a plurality of connective members for holding the block members in a predetermined position on said surface area; and d) said block members each having a magnetic element disposed on a bottom portion thereof and a mating magnetic element on said surface area of said chair with pairs of magnetic elements facing each other having a similar external polarity thereby providing magnetic repulsion suspending said block members away from said mating magnetic elements on said surface area of said chair.

9. The modular block building system according to claim 8 whereby said connective members are selected from the group consisting of cord, fiber, string, bungee cord, polymeric line and elastic line extending through or attached to a plurality of said block members to maintain their adjacent relation with the neighboring block members.

10. The modular block building system according to claim 8, wherein said connective members are adapted to facilitate the displacement of said block members when a bias is applied thereto and to return said block members to their original positions once said bias is removed therefrom.

11. The modular block building system according to claim 8, wherein said connective members are selected from the group consisting of mating hook and loop fastener strips, and magnetic elements.

* * * * *